US011821313B2

(12) United States Patent
Kenno et al.

(10) Patent No.: US 11,821,313 B2
(45) **Date of Patent: *Nov. 21, 2023**

(54) WASHERLESS CUTTING TOOL ASSEMBLY

(71) Applicant: Kennametal Inc., Latrobe, PA (US)

(72) Inventors: Brandon J. Kenno, Windber, PA (US); James R. Geyer, Manns Choice, PA (US)

(73) Assignee: KENNAMETAL INC., Latrobe, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/098,516

(22) Filed: Jan. 18, 2023

(65) Prior Publication Data

US 2023/0151734 A1 May 18, 2023

Related U.S. Application Data

(63) Continuation of application No. 17/198,747, filed on Mar. 11, 2021, now Pat. No. 11,585,217.

(51) Int. Cl.
*E21C 35/197* (2006.01)
*E21C 35/183* (2006.01)

(52) U.S. Cl.
CPC ..... *E21C 35/197* (2013.01); *E21C 35/1835* (2020.05)

(58) Field of Classification Search
CPC ..... E21C 35/197; E21C 35/18; E21C 35/1835
See application file for complete search history.

(56) References Cited

U.S. PATENT DOCUMENTS

| | | | |
|---|---|---|---|
| 4,149,753 | A | 4/1979 | Stoltz et al. |
| 4,247,150 | A | 1/1981 | Wrulich et al. |
| T103,602 | I4 | 11/1983 | Retkowski |
| 4,603,911 | A | 8/1986 | Hindmarsh et al. |
| 4,684,176 | A | 8/1987 | Den Besten et al. |
| 4,921,310 | A | 5/1990 | Hedlund et al. |
| 5,628,549 | A | 5/1997 | Ritchey et al. |
| 6,375,272 | B1 | 4/2002 | Ojanen |
| D627,804 | S | 11/2010 | Fader et al. |

(Continued)

FOREIGN PATENT DOCUMENTS

EP 3259447 B1 1/2020

OTHER PUBLICATIONS

Feb. 3, 2022 Non-Final OA U.S. Appl. No. 17/198,747, 21 Pages.

(Continued)

*Primary Examiner* — Janine M Kreck
(74) *Attorney, Agent, or Firm* — Christopher J. Owens

(57) ABSTRACT

A washerless cutting tool assembly includes a cutting tool holder and a rotatable cutting tool at least partially disposed within the cutting tool holder. The cutting tool holder includes an alignment feature in the form of a protrusion at an axial forward end and a groove at an axial rearward end of the head portion of the rotatable cutting tool. The groove is capable of receiving the protrusion of the cutting tool holder to align the central, longitudinal axis of rotatable cutting tool with the central, longitudinal axis of the cutting tool holder. The cutting tool assembly further includes a limited rotated feature in the form of a braking ring disposed within an annular groove and a retainer ring disposed over the braking ring.

19 Claims, 5 Drawing Sheets

(56) References Cited

U.S. PATENT DOCUMENTS

| | | | |
|---|---|---|---|
| 8,500,209 | B2 | 8/2013 | Hall et al. |
| D742,948 | S | 11/2015 | Kenno et al. |
| D742,949 | S | 11/2015 | Kenno et al. |
| 9,567,811 | B2 | 2/2017 | Kenno |
| D818,507 | S | 5/2018 | Swope et al. |
| D839,936 | S | 2/2019 | Weber et al. |
| 10,260,341 | B2 | 4/2019 | Kammerer et al. |
| 10,294,786 | B2 | 5/2019 | Weber et al. |
| D868,122 | S | 11/2019 | Rose et al. |
| 10,465,512 | B2 | 11/2019 | Kenno et al. |
| D920,401 | S | 5/2021 | Congdon et al. |
| D938,999 | S | 12/2021 | Congdon et al. |
| D963,718 | S | 9/2022 | Congdon et al. |
| 11,585,217 | B2 * | 2/2023 | Kenno ..... E21C 35/1835 |
| 2003/0047985 | A1 | 3/2003 | Stiffler |
| 2004/0118615 | A1 | 6/2004 | Beach |
| 2008/0030065 | A1 | 2/2008 | Frear |
| 2009/0108664 | A1 | 4/2009 | Hall et al. |
| 2012/0242136 | A1 | 9/2012 | Ojanen |
| 2013/0169022 | A1 | 7/2013 | Monyak et al. |
| 2013/0169023 | A1 | 7/2013 | Monyak et al. |
| 2014/0339882 | A1 | 11/2014 | Hall et al. |
| 2015/0252670 | A1 | 9/2015 | Wachsmann et al. |
| 2016/0230551 | A1 | 8/2016 | Lehnert et al. |
| 2017/0342831 | A1 | 11/2017 | Weber et al. |
| 2018/0073359 | A1 | 3/2018 | Kraemer et al. |
| 2018/0245467 | A1 | 8/2018 | Kenno et al. |
| 2019/0106988 | A1 | 4/2019 | Buhr et al. |

OTHER PUBLICATIONS

Oct. 26, 2022 Notice of Allowance U.S. Appl. No. 17/198,747, 7 pages.

Nov. 23, 2022 Notice of Allowance U.S. Appl. No. 29/773,760, 6 pages.

Sep. 20, 2023 Non-Final Office Action U.S. Appl. No. 17/198,856, 19 Pages.

* cited by examiner

WASHERLESS CUTTING TOOL ASSEMBLY

FIELD OF THE DISCLOSURE

In general, the invention relates to a cutting tool assembly for the impingement of a substrate or earth strata, such as, for example, asphaltic roadway material, coal deposits, mineral formations, and the like. More specifically, the invention pertains to a cutting tool assembly with an alignment feature that eliminates the washer needed to properly align the rotatable cutting tool with the cutting tool holder. The invention also pertains to a cutting tool assembly with a limited rotation feature that selectively controls the amount of rotation of the rotating cutting tool during operation.

BACKGROUND OF THE DISCLOSURE

Rotatable cutting tools are useful for the impingement of a substrate or earth strata such as, for example, asphaltic roadway material, coal deposits, mineral formations and the like. Such a cutting tool typically presents a generally elongate, cylindrical geometry. The cutting tool comprises an elongate cutting tool body, which has an axially forward end and an opposite axially rearward end. A hard cutting member or a super hard cutting member typically affixes to the axial forward end of the cutting tool body. The cutting tool body typically carries an assembly or means by which the cutting tool is rotatably carried by a stationary block or holder on a drum.

Such rotatable cutting tools can experience extreme wear and failure in a number of ways due to the environment in which they operate and must be frequently replaced. Thus, it would be highly desirable to provide an improved cutting tool that experiences an increase in useful tool life with less parts and easier to manufacture, while reducing cost, as compared to conventional cutting tools.

SUMMARY OF THE DISCLOSURE

The problem of increasing the useful tool life of a rotatable cutting tool assembly, while reducing cost can be solved by eliminating the need for a washer that is required in conventional rotatable cutting tool assemblies for alignment of the cutting tool body with the cutting tool holder.

In one aspect, a washerless cutting tool assembly comprises a cutting tool holder having a central, longitudinal axis and a rotatable cutting tool at least partially disposed within the cutting tool holder. The rotatable cutting tool has a central, longitudinal axis and includes a cutting tool body having a head portion and a shank portion axially rearward of the head portion. The head portion and the shank portion are capable of being rotated about the central, longitudinal axis. The head portion includes a cutting member at an axial forward end thereof, a bolster portion axially rearward of the cutting member and a base portion at an axial rearward end of the head portion. The bolster portion includes a convex shape section having a socket at an axial forward end thereof. The cutting member is affixed to the cutting tool body within the socket. The cutting tool holder includes a protrusion at an axial forward end thereof, and the rotatable cutting tool includes a groove at an axial rearward end of the head portion, wherein the groove is capable of receiving the protrusion of the cutting tool holder to align the central, longitudinal axis of the rotatable cutting tool with the central, longitudinal axis of the cutting tool holder.

In another aspect, a rotatable cutting tool comprises a cutting tool body having a head portion and a shank portion axially rearward of the head portion. The head portion and the shank portion are capable of being rotated about a central, longitudinal axis. The head portion includes a cutting member at an axial forward end thereof, a bolster portion axially rearward of the cutting member and a base portion at an axial rearward end of the head portion. The bolster portion includes a convex shape section having a socket at an axial forward end thereof. The cutting member is affixed to the cutting tool body within the socket. The cutting tool holder includes a protrusion at an axial forward end thereof, and the rotatable cutting tool includes a groove at an axial rearward end of the head portion, wherein the groove is capable of receiving the protrusion of the cutting tool holder to align the central, longitudinal axis of the rotatable cutting tool with a central, longitudinal axis of the cutting tool holder.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

DETAILED DESCRIPTION

Figure 1:
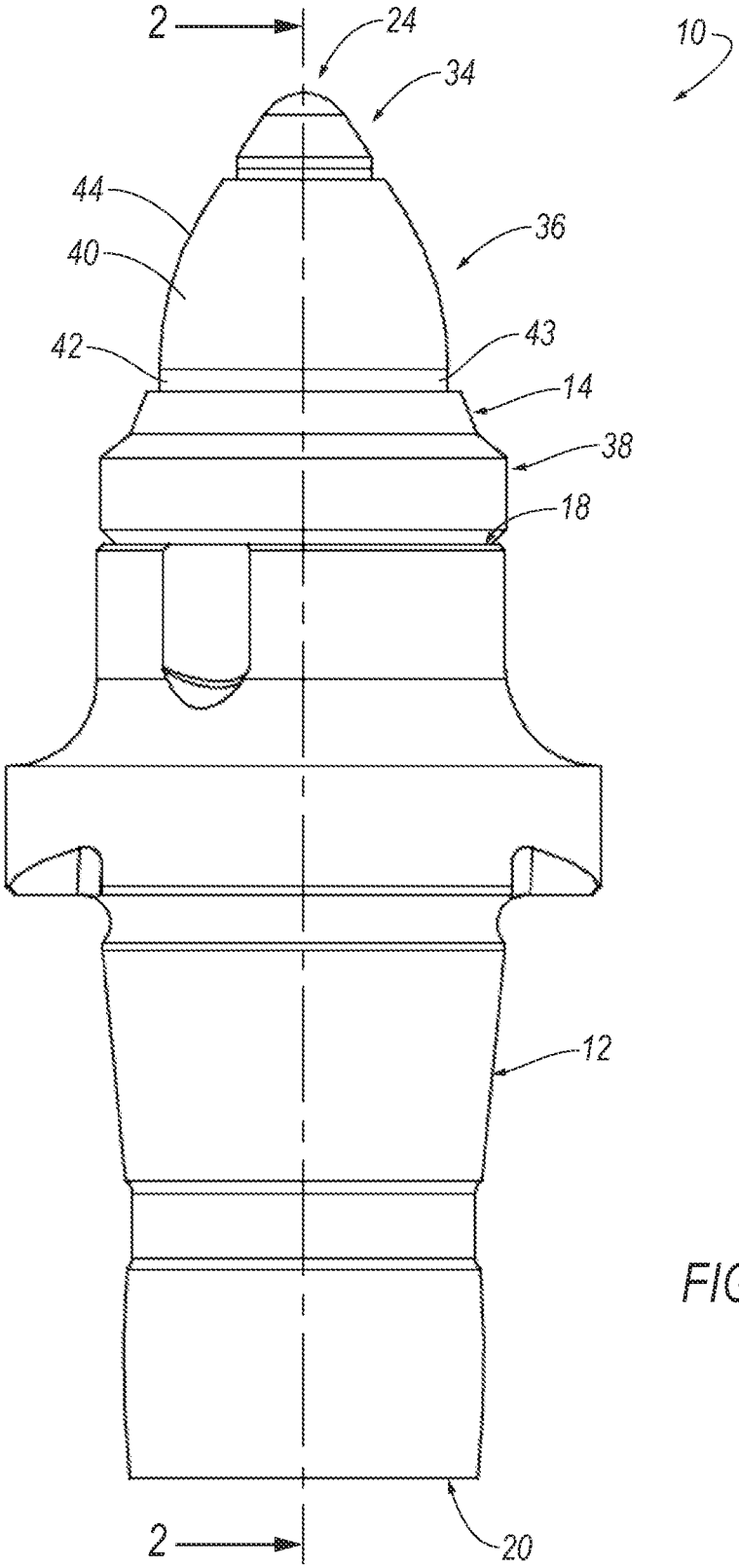
FIG. 1 is a side view of a washerless cutting tool assembly according to an embodiment of the invention.

Referring now to FIGS. 1-5, a washerless cutting tool assembly 10 is shown according to an embodiment of the invention. In one aspect, the cutting tool assembly 10 illustrated herein pertains generally to road planning tools. However, it should be appreciated that the invention has application to other kinds of cutting tools useful in other kinds of cutting operations. Exemplary operations include without limitation road planning (or milling), coal mining, concrete cutting, and other kinds of cutting operations wherein a cutting tool with a hard cutting member impinges against a substrate (e.g., earth strata, pavement, asphaltic highway material, concrete, and the like) breaking the substrate into pieces of a variety of sizes including larger-size pieces or chunks and smaller-sized pieces including dust-like particles. In addition, it will be appreciated that the cutting tool assembly 10 of the invention may be manufactured in various sizes and dimensions depending upon the desired application of the tool. In another aspect, as used herein, the term "cutting tool" generally refers to rotatable cutting tools.

Directional phrases used herein, such as, for example, left, right, front, back, top, bottom and derivatives thereof, relate to the orientation of the elements shown in the drawings and are not limiting upon the claims unless expressly recited therein. Identical parts are provided with the same reference number in all drawings.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Throughout the text and the claims, use of the word "about" in relation to a range of values (e.g., "about 22 to 35 wt %") is intended to modify both the high and low values recited, and reflects the penumbra of variation associated with measurement, significant figures, and interchangeability, all as understood by a person having ordinary skill in the art to which this invention pertains.

For purposes of this specification (other than in the operating examples), unless otherwise indicated, all numbers expressing quantities and ranges of ingredients, process conditions, etc., are to be understood as modified in all instances by the term "about". Accordingly, unless indicated to the contrary, the numerical parameters set forth in this specification and attached claims are approximations that can vary depending upon the desired results sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Further, as used in this specification and the appended claims, the singular forms "a", "an" and "the" are intended to include plural referents, unless expressly and unequivocally limited to one referent.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements including that found in the measuring instrument. Also, it should be understood that any numerical range recited herein is intended to include all sub-ranges subsumed therein. For example, a range of "1 to 10" is intended to include all sub-ranges between and including the recited minimum value of 1 and the recited maximum value of 10, i.e., a range having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

As used herein, the term "elongate" is defined as something that is longer than it is wide. In other words, the width is smaller than its length.

As used herein, the term "circular" is defined as an object having a shape of a circle, i.e., an object having a simple closed shape. It is the set of points in a plane that are at a given distance from a given point, the center; equivalently it is the curve traced out by a point that moves in a plane so that its distance from a given point is constant. The distance between any of the points and the center is called the radius.

Figure 2:
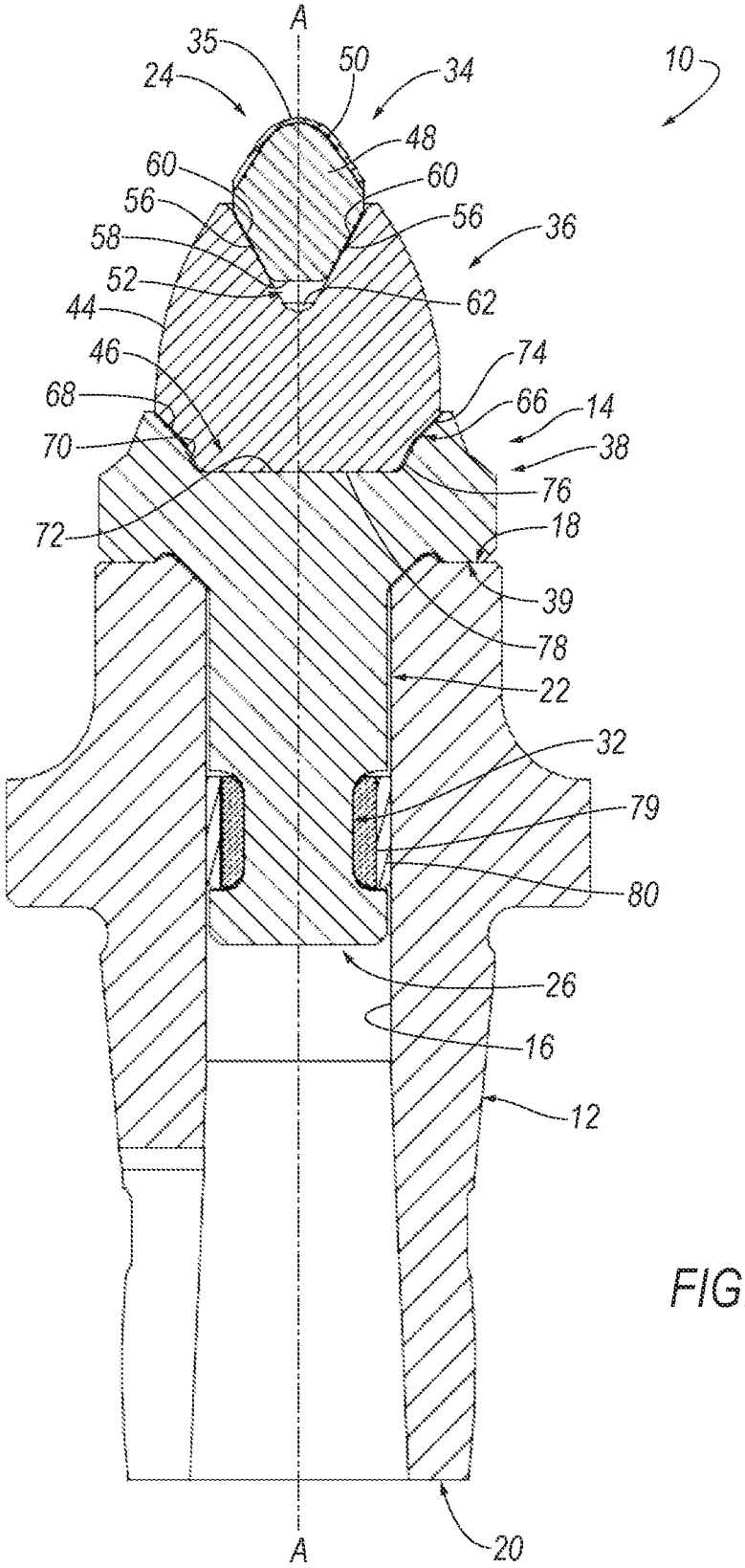
FIG. 2 is a cross-sectional view of the washerless cutting tool assembly taken along line 2-2 of FIG. 1.

As shown in FIGS. 1 and 2, the washerless cutting tool assembly 10 comprises two main components: a cutting tool holder, shown generally at 12, having a longitudinal axis, A-A, and a rotatable cutting tool, shown generally at 14. In the illustrated embodiment, the cutting tool holder 12 is in the form of a sleeve member in which a portion of the rotatable cutting tool 14 is inserted within a bore 16 of the cutting tool holder 12. In the illustrated embodiment, the rotatable cutting tool 14 is held in the cutting tool holder 12 with a friction fit created by compressing the retaining ring 80. As is known in the art, the cutting tool 14 can be rotatably carried by the cutting tool holder 12 by inserting the cutting tool holder 12 into a bore of a drum (not shown). The cutting tool holder 12 has an axial forward end 18 and an axial rearward end 20.

Referring now to FIGS. 2-5, the rotatable cutting tool 14 has a central, longitudinal axis B-B. In one aspect, the rotatable cutting tool 14 is rotatable about the axis B-B. In another aspect, rotatable cutting tool 14 may be symmetrical about the axis B-B. When the rotatable cutting tool 14 is properly mounted in the cutting tool holder 12, the axis B-B of the rotatable cutting tool 14 is substantially aligned with the central, longitudinal axis A-A of the cutting tool holder 12.

The rotatable cutting tool 14 includes an elongate cutting tool body, generally designated as 22. In one aspect, the elongate cutting tool body 22 presents a generally cylindrical geometry and has an axial forward end 24 and an axial rearward end 26.

Figure 4:
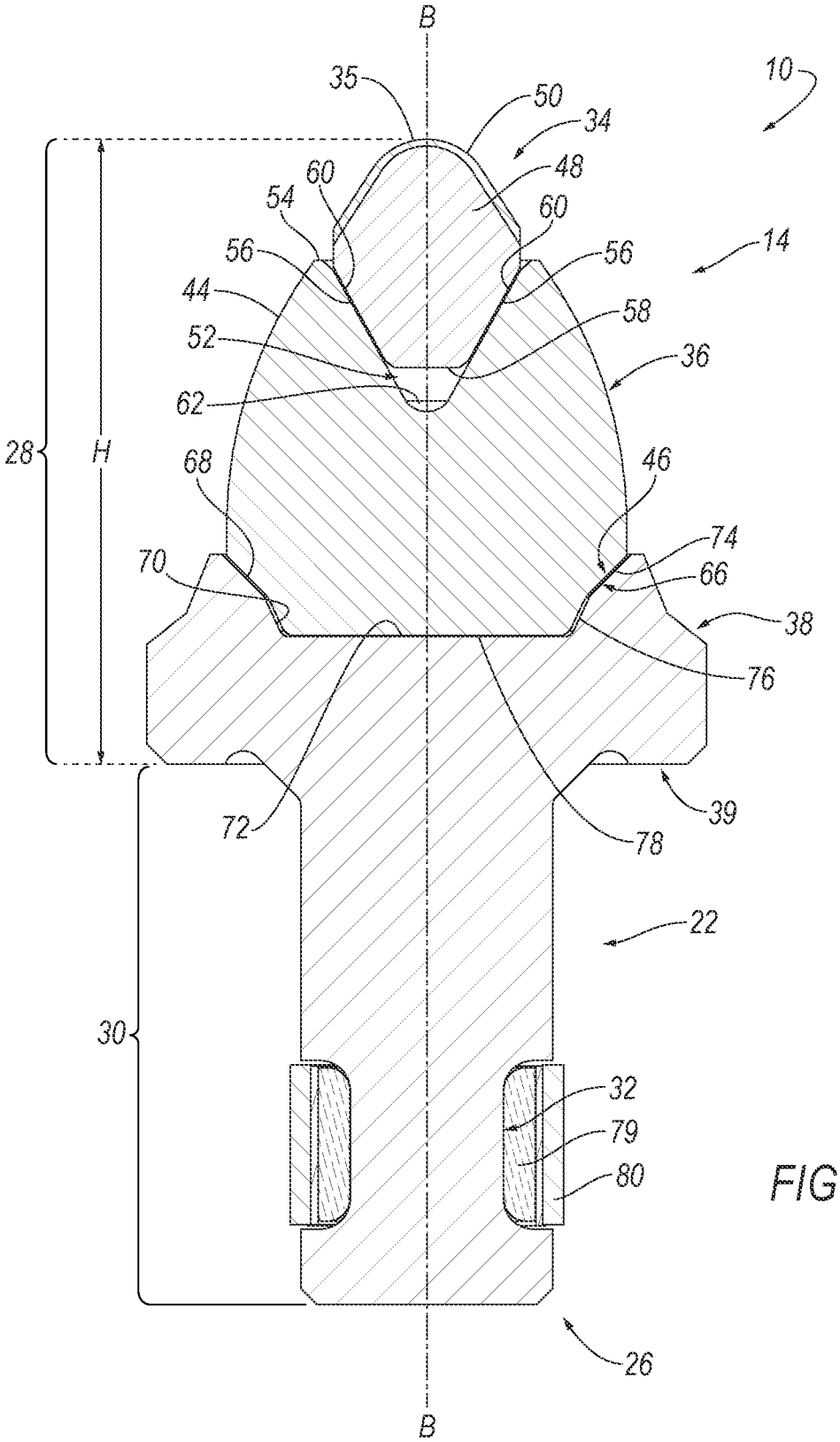
FIG. 4 is a cross-sectional view of the rotatable cutting tool assembly taken along line 4-4 of FIG. 3.

The elongate cutting tool body 22 includes a head or head portion 28 and a shank or shank portion 30 axially rearward of the head portion 28. In one aspect, the shank 30 includes an annular groove 32 adjacent the axial rearward end 26 (FIGS. 2 and 4). It will be appreciated that the head 28 and the shank 30 may have various sizes, shapes and/or configurations in accordance with aspects of the invention.

In the illustrated embodiment, the head 28 includes a cutting member 34 at an axially forward end 35 of the head 28, a bolster portion 36 axially rearward of the cutting member 34 and a base portion 38 at an axial rearward end 39 of the head 28.

The bolster portion 36 includes a convex shape section 40 and a generally cylindrical section 42 contiguous with and axially rearward of the convex shape section 40. In the illustrated embodiment, the convex shape section 40 is generally convex with an outer surface 44 being generally arcuate and curving outwardly from the central longitudinal axis B-B of the rotatable cutting tool 14. In addition, the generally cylindrical section 42 is generally cylindrical in shape about the central, longitudinal axis B-B and includes an outer surface 43 that is generally linear and thus generally parallel to the central, longitudinal axis B-B. In one embodiment, the bolster portion 36 of the head 28 includes, at least in part, a cemented (cobalt) tungsten carbide material.

Figure 3:
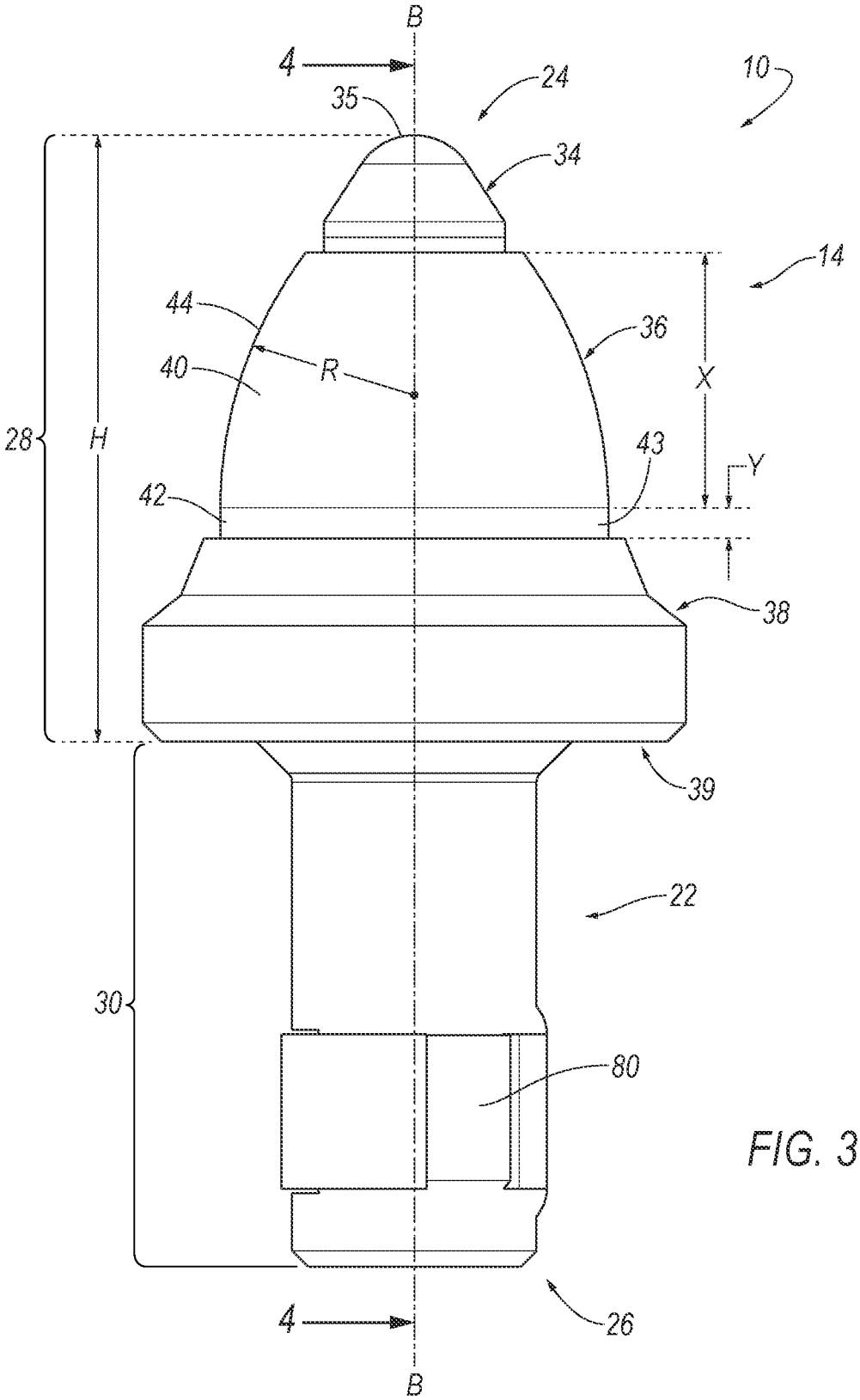
FIG. 3 is a side view of a rotatable cutting tool of the washerless cutting tool assembly according to an embodiment of the invention.

As shown in FIG. 3, the head 28 has an overall axial length dimension, H, the convex shape section 40 of the bolster portion 26 has an axial length dimension, X, and the generally cylindrical section 42 of the bolster portion 36 has an axial length dimension, Y.

In one embodiment, the axial length dimension, X, can be in the range of about 0.3 inches to about 1.0 inches. In another embodiment, the axial length dimension, X, can be in the range of about 0.6 inches to about 0.9 inches. In yet another embodiment, the axial length dimension, X, can be in the range of about 0.7 inches to about 0.8 inches.

In one embodiment, the axial length dimension, Y, can be in the range of about 0.03 inches to about 0.55 inches. In another embodiment, the axial length dimension, Y, can be in the range of about 0.1 inches to about 0.3 inches.

In one embodiment, the axial length dimension, H, can be in the range of about 1.7 inches to about 1.8 inches. In another embodiment, the axial length dimension, H, can be in the range of about 1.72 inches to about 1.78 inches.

In one embodiment, the ratio (X+Y)/H is in the range between about 0.25 to about 0.80.

In one embodiment, the axial length dimension, X, can be in the range of about 0.3 inches to about 1.0 inches, the axial length dimension, Y, can be in the range of about 0.03 inches to about 0.55 inches, the axial length dimension, H, can be in the range of about 1.7 inches to about 1.8 inches and the ratio (X+Y)/H can be in the range of about 0.5 to about 0.75.

Advantageously, a bolster portion 36 having the dimensions and/or ratios set forth herein along with being formed, at least in part, of a cemented (cobalt) tungsten carbide material allows for the bolster portion 36 to retain its shape and integrity for a longer period of time during use and aids in reducing wear to other components of the cutting tool assembly 10, such as, for example, the shank 30 or cutting tool holder 12 for receiving the rotatable cutting tool 14.

In another aspect of the invention, the convex shape section 40 of the bolster portion 36 can have a radius, R (FIG. 3). In one embodiment, the radius, R, can be in the range of about 1.2 inches to about 1.4 inches. In another embodiment, the radius, R, can be in the range of about 0.85 inches to about 1.35 inches. Advantageously, this configuration of having the radius, R, provides the necessary structure and support for the cutting member 34. In addition, this configuration advantageously provides, for example, the ability to add mass or size to the bolster portion 36 for improved wear while still maintaining a streamlined design for efficient cutting.

In another aspect, the ratio Y/X (i.e., the ratio of the axial length dimension of the generally cylindrical section 42 to the axial length dimension of the convex shape section 40) can be in the range of about 0.05 to about 1.0. In one embodiment, the ratio Y/X is in the range of about 0.1 to about 0.6. In another embodiment, the ratio Y/X is in the range of about 0.125 to about 0.300. Advantageously, this configuration regarding the ratio Y/X provides support and/or protection for the cutting member 34 during cutting and can reduce moment loading on the shank 30, thereby reducing wear and extending the life of the cutting tool assembly 10.

Figure 5:
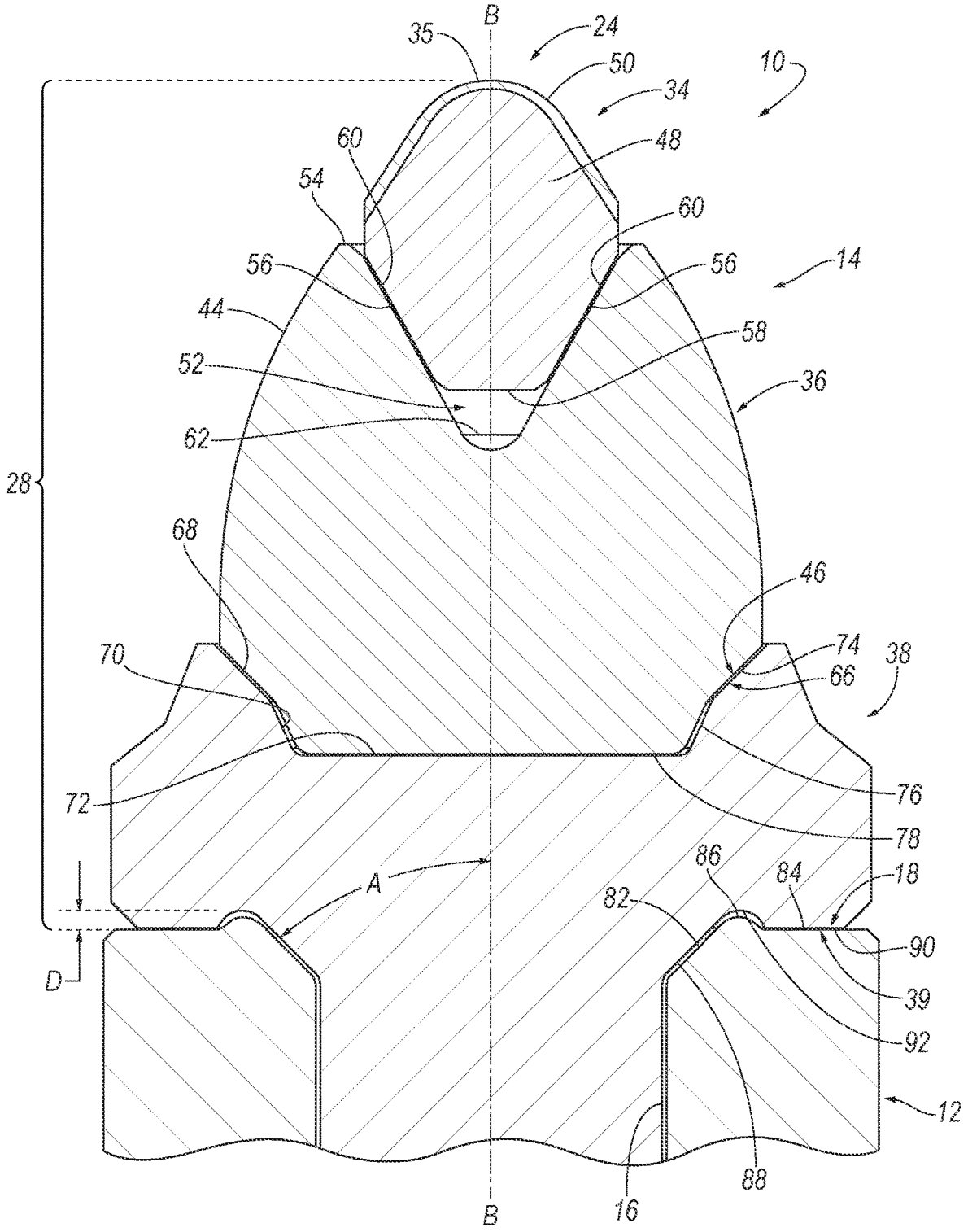
FIG. 5 is an enlarged cross-sectional view of the alignment feature of the invention showing the cooperation between a protrusion on the axial forward end of the cutting tool holder and the groove on the axial rearward end of the rotatable cutting tool.

Referring particularly to FIGS. 4 and 5, the cutting member 34 includes a substrate 48 and a layer of a super hard material 50 adhered to the substrate 48. The substrate 48 of the cutting member 34 is made of, at least in part, a cemented (cobalt) tungsten carbide material. The layer of super hard material 50 can be made of, for example, polycrystalline diamond (PCD) or polycrystalline cubic boron nitride (PcBN). The layer of super hard material 50 may have a generally constant thickness and can be applied to the substrate 48 by any one of a number of known techniques in which the super hard material 50 is bonded to the surface of the substrate 48. In addition, the layer of super hard material 50 is shown as having a particular shape, but it will be appreciated that it may have other shapes, configurations and/or thicknesses as desired or required for particular cutting operations.

In the illustrated embodiment, the substrate 48 of the cutting member 34 includes sidewalls 56 that generally taper in the axial rearward direction. The substrate 48 also includes a bottom surface 58.

Referring to FIGS. 2, 4 and 5, the bolster portion 36 includes a socket 52 at an axial forward end 54 that is configured for receiving and affixing the cutting member 34 to the cutting tool body 14. Generally, the socket 52 includes a sidewall 60 configured for cooperating with and receiving the substrate 48 of the cutting member 34. More particularly, the socket 52 includes sidewalls 60 structured and arranged for receiving the tapered sidewalls 56 of the substrate 48 of the cutting member 34. In one embodiment, the sidewalls 60 of the socket 52 generally taper in the axial rearward direction, similar to the tapering of the sidewalls 56 of the substrate 48. In the illustrated embodiment, the socket 52 includes a bottom surface 62 that, in one example, may be spaced apart from the bottom surface 58 of the substrate 48.

In the illustrated embodiment, the cutting member 34 can be affixed to the bolster portion 36 by brazing the sidewalls 56 of the substrate 48 to the sidewalls 60 of the socket 52. Although not required, brazing may also be provided between the bottom surface 58 of the substrate 48 and a bottom surface 62 of the socket 52. In order to enhance the brazing between the sidewalls 56 of the substrate 48 and the sidewalls 60 of the socket 52, a plurality of projections (not shown) may be provided and formed on the sidewall 60 of the socket 52. Generally, the plurality of projections (not shown) are configured for cooperating with the substrate 48 of the cutting member 34 for affixing the cutting member 34 to the cutting tool body 14. More particularly, the projections (not shown) provide a raised surface that extends outwardly from the sidewall 60 such that the sidewall 56 of the substrate 48 contacts and rests thereon providing spacing or a gap between sidewalls 56 and 60 so as to allow the braze to flow more easily and uniformly between the sidewalls 56 and 60. In addition, the projections (not shown) can provide for accurate positioning, for example, centering, of the substrate 48 in the socket 52. It will be appreciated that other configurations and arrangements of the projections (not shown) can be provided in accordance with aspects of the invention. In addition, it will be appreciated that the substrate 48, the cutting member 34 and/or the socket 52 may have various shapes, sizes and configurations in accordance with aspects of the invention.

As shown in FIGS. 2, 4 and 5, the base portion 38 defines a pocket 66 configured for cooperating with and receiving the axial rearward end 46 of the bolster portion 36 for affixing or securing the bolster portion 36 to the base portion 38. In one example, the pocket 66 can include a first segment 68, a second segment 70 axially rearward of the first segment 68 and a bottom 72 disposed rearward of the first and second segments 68, 70. It will be appreciated that other configurations and arrangements for the pocket 66 can be provided in accordance with aspects of the invention.

Referring again to FIGS. 2, 4 and 5, in one example a rearward end 46 of the bolster portion 36 includes a first portion 74, a second portion 76 axially rearward of the first portion 74, and a bottom portion 78 rearward of the first and second portions 74, 76. It will be appreciated that other configurations and arrangements for the rearward end 46 can be provided in accordance with aspects of the invention. In addition, it will be appreciated that the pocket 66 is configured and arranged for receiving and affixing the rearward end 46 thereto.

More particularly, in one embodiment, the rearward end 46 of the bolster portion 36 can be affixed or attached by brazing the first portion 74, the second portion 76 and/or the bottom portion 78 to the first segment 68, second segment 70 and/or the bottom 72, respectively, of the pocket 66. In order to enhance the described brazing a plurality of projections (not shown) may be provided and formed on the first portion 74 of the rearward end 46. In addition, to further enhance the brazing, a plurality of ribs (not shown) can be provided and formed on the second portion 76 of the rearward end 46.

Referring now to FIGS. 2-4, the rotatable cutting tool 14 includes a limited rotation feature. In the illustrated embodiment, the limited rotation feature comprises a braking ring 79 disposed within the annular groove 32 in the shank 30, and a wedding-style retainer ring 80 disposed over the braking ring 79. The braking ring 79 of made of a suitable material that acts as a brake to slow, limit and/or stop the rotation of the rotatable cutting tool 14 during operation. The braking ring 79 can be made of any suitable material, such as urethane, and the like. By slowing, limiting and/or stopping the rotation of the rotatable cutting tool 14 by a certain percentage, for example, 25-50%, it is estimated that the tool life is increased by approximately the same percentage. If the braking ring 79 and the retainer ring 80 are sufficiently tightened, the rotation of the rotatable cutting tool 14 could be completely stopped and the rotatable cutting tool 14 can then be considered an indexable cutting tool that can be rotated by the user on a daily, weekly or monthly basis, depending on the needs of the application. In addition, the rotatable cutting tool 14 can be easily removed when the user needs to switch back to a cutting tool having a cutting member 34 made of a different material, such as carbide, and the like.

As mentioned above, the central, longitudinal axis B-B of the rotatable cutting tool 14 is substantially aligned with the central, longitudinal axis A-A of the cutting tool holder 12 when the rotatable cutting tool 14 is properly mounted in the cutting tool holder 12. In conventional cutting tool assemblies, this is accomplished by the use of a washer disposed between the rotatable cutting tool and the cutting tool holder.

One aspect of the invention is that the washer used in conventional cutting tool assemblies for aligning the rotatable cutting tool 14 with the cutting tool holder 12 is eliminated in the cutting tool assembly 10 of the invention, thereby reducing the cost of manufacture, while extending the life of the cutting tool assembly 10.

Referring to FIG. 5, the elimination of a washer in conventional cutting tools is achieved by providing a chamfered surface 82, a radial support surface 84, and a protrusion 86 at the axial forward end 18 of the cutting tool holder 12. In one embodiment, the chamfered surface 82 extends at an angle, A, in a range between about 30 and 60 degrees with respect to the central, longitudinal axis, B-B. As shown in FIG. 5, the protrusion 86 extends axially forward with respect to the radially extending support surface 84 by a distance, D. In other words, the protrusion 86 extends upward from the radial support surface 84 towards the axial forward end 24 of the rotatable cutting tool 14. In one embodiment, the distance, D, is in the range of about 0.5 mm to about 10 mm. In one embodiment, the radial support surface 84 extends substantially perpendicular with respect to the central, longitudinal axis A-A of the cutting tool holder 12. However, it will be appreciated that the radially extending support surface 84 can extend at an acute or obtuse angle with respect to the central longitudinal axis, A-A. It will be appreciated that other configurations and arrangements for the axial forward end 18 can be provided in accordance with aspects of the invention.

Similarly, the axial rearward end 39 of the head 28 of the rotatable cutting tool 14 is provided with a chamfered surface 88, a radial support surface 90, and a groove 92 disposed between the chamfered surface 88 and the radial support surface 90 that cooperate with the chamfered surface 82, the radial support surface 84 and the protrusion 86, respectively, of the cutting tool holder 12. In particular, the chamfered surface 88 of the rotatable cutting tool 14 extends at substantially the same angle, A, with respect to the central, longitudinal axis, B-B, as the chamfered surface 82 of the cutting tool holder 12. In addition, the groove 92 has at least a depth, D, to allow the protrusion 86 to be completely disposed therein. In one embodiment, the groove 92 comprises an annular groove. Further, the radial support surface 90 of the rotatable cutting tool 14 is substantially perpendicular to the central, longitudinal axis, B-B.

The cooperation between the protrusion 86 of the cutting tool holder 12 and the annular groove 92 of the rotatable cutting tool 14 provides an alignment feature that enables the rotatable cutting tool 14 to be properly aligned with the cutting tool holder 12, thereby eliminating the need for a washer required in conventional cutting tool assemblies.

The patents and publications referred to herein are hereby incorporated by reference.

Having described presently preferred embodiments the invention may be otherwise embodied within the scope of the appended claims.

What is claimed is:

1. A washerless cutting tool assembly, comprising:

a cutting tool holder having a central, longitudinal axis; and a rotatable cutting tool at least partially disposed within the cutting tool holder, the rotatable cutting tool having a central, longitudinal axis and including a cutting tool body having a head portion and a shank portion axially rearward of the head portion, the head portion and the shank portion capable of being rotated about the central, longitudinal axis, the head portion including a cutting member at an axial forward end thereof, the cutting member being affixed to the cutting tool body within a socket at an axial forward end thereof, wherein the cutting tool holder includes a protrusion at an axial forward end thereof, and wherein the rotatable cutting tool includes a groove at an axial rearward end of the head portion, the groove capable of receiving the protrusion of the cutting tool holder to align the central, longitudinal axis of rotatable cutting tool with the central, longitudinal axis of the cutting tool holder, wherein the protrusion of the cutting tool holder is disposed between a chamfered surface and a radial support surface, and wherein the groove of the rotatable cutting tool is disposed between a chamfered surface and a radial support surface that cooperate with the chamfered surface and the radial support surface of the cutting tool holder.

2. The washerless cutting tool assembly of claim 1, wherein the shank portion includes a limited rotation feature comprising a braking ring disposed within the annular groove in the shank portion, and a retainer ring disposed over the braking ring to limit rotation of the rotating cutting tool during operation.

3. The washerless cutting tool assembly of claim 1, wherein the cutting member includes a substrate and a layer of super hard material adhered to the substrate.

4. The washerless cutting tool assembly of claim 3, wherein the substrate of the cutting member includes a sidewall that tapers in an axial rearward direction.

5. The washerless cutting tool assembly of claim 4, wherein the socket includes a sidewall configured for receiving the substrate of the cutting member.

6. The washerless cutting tool assembly of claim 1, further comprising a bolster portion axially rearward of the cutting member and a base portion at an axial rearward end of the head portion.

7. The washerless cutting tool assembly of claim 6, wherein the bolster portion further includes a generally cylindrical section contiguous with the convex shape section, and wherein the head portion has an axial length dimension, H, the convex shape section has an axial length dimension, X, and the generally cylindrical section has an axial length dimension Y, the ratio (X+Y)/H being in the range of 0.25 to about 0.80.

8. The washerless cutting tool assembly of claim 7, wherein the ratio Y/X is in the range of about 0.05 to about 1.0.

9. The washerless cutting tool assembly of claim 7, wherein the convex shape section of the bolster portion has a radius, R, in the range of about 0.85 inches to about 1.4 inches.

10. A rotatable cutting tool comprising a cutting tool body having a head portion and a shank portion axially rearward of the head portion, the head portion and the shank portion capable of being rotated about a central, longitudinal axis, the head portion including a cutting member at an axial forward end thereof, the cutting member being affixed to the cutting tool body within a socket at an axial forward end thereof, wherein the rotatable cutting tool includes an annular groove at an axial rearward end of the head portion, the annular groove disposed between the chamfered surface and the radial support surface that cooperate with a chamfered surface and a radial support surface of the cutting tool holder, the groove capable of receiving a protrusion of a cutting tool holder to align the central, longitudinal axis of the rotatable cutting tool with a central, longitudinal axis of the cutting tool holder.

11. The rotatable cutting tool of claim 10, wherein the shank portion includes a limited rotation feature comprising a braking ring disposed within the annular groove in the shank portion, and a retainer ring disposed over the braking ring to limit rotation of the rotating cutting tool during operation.

12. The rotatable cutting tool of claim 10, further comprising a bolster portion axially rearward of the cutting member and a base portion at an axial rearward end of the head portion.

13. The rotatable cutting tool of claim 12, wherein the bolster portion further includes a generally cylindrical section contiguous with the convex shape section, and wherein the head portion has an axial length dimension, H, the convex shape section has an axial length dimension, X, and the generally cylindrical section has an axial length dimension Y, the ratio (X+Y)/H being in the range of 0.25 to about 0.80.

14. The rotatable cutting tool of claim 13, wherein the ratio Y/X is in the range of about 0.05 to about 1.0.

15. The rotatable cutting tool of claim 12, wherein the convex shape section of the bolster portion has a radius, R, in the range of about 0.85 inches to about 1.4 inches.

16. The rotatable cutting tool of claim 10, wherein the cutting member includes a substrate and a layer of super hard material adhered to the substrate.

17. The rotatable cutting tool of claim 16, wherein the substrate of the cutting member includes a sidewall that tapers in an axial rearward direction.

18. The rotatable cutting tool of claim 17, wherein the socket includes a sidewall configured for receiving the substrate of the cutting member.

19. A combination rotatable cutting tool and cutting tool holder, comprising:

a cutting tool holder having a central, longitudinal axis, the cutting tool holder comprising an axial forward end and an axial rearward end, the axial forward end including a chamfered surface, a radial support surface and a protrusion, the protrusion disposed between the chamfered surface and the radial support surface; and a rotatable cutting tool comprising a cutting tool body having a head portion and a shank portion axially rearward of the head portion, the head portion and the shank portion capable of being rotated about a central, longitudinal axis, the head portion including a cutting member at an axial forward end thereof, the cutting member being affixed to the cutting tool body within a socket at an axial forward end thereof, wherein the rotatable cutting tool includes a groove at an axial rearward end of the head portion, the groove disposed between the chamfered surface and the radial support surface, the groove capable of receiving the protrusion of the cutting tool holder to align the central, longitudinal axis of the rotatable cutting tool with the central, longitudinal axis of the cutting tool holder.

* * * * *